US005332492A

United States Patent [19]

Maurer et al.

[11] Patent Number: 5,332,492

[45] Date of Patent: Jul. 26, 1994

[54] PSA PROCESS FOR IMPROVING THE PURITY OF HYDROGEN GAS AND RECOVERY OF LIQUEFIABLE HYDROCARBONS FROM HYDROCARBONACEOUS EFFLUENT STREAMS

[75] Inventors: Richard T. Maurer, Nanuet; Michael J. Mitariten, Peekskill; Roger J. Weigand, Croton On Hudson, all of N.Y.; Michael Whysall, Wilrijk, Belgium

[73] Assignee: UOP, Des Plaines, Ill.

[21] Appl. No.: 74,629

[22] Filed: Jun. 10, 1993

[51] Int. Cl.[5] ..... C10G 35/04; C10G 67/06; C10G 25/06

[52] U.S. Cl. ..... 208/340; 208/99; 208/100; 208/101; 208/102; 208/103; 208/133; 208/134

[58] Field of Search ..... 208/340, 101, 99, 100, 208/102, 103, 133, 134; 585/650; 55/25, 26; 48/62 R; 423/652

[56] References Cited

U.S. PATENT DOCUMENTS

| | | | |
|---|---|---|---|
| 3,430,418 | 3/1969 | Wagner | 55/25 |
| 3,431,195 | 3/1969 | Storch et al. | 208/101 |
| 3,564,816 | 2/1971 | Batta | 55/26 |
| 3,986,849 | 10/1976 | Fuderer et al. | 55/25 |
| 4,364,820 | 12/1982 | DeGraff et al. | 208/101 |
| 4,374,726 | 2/1983 | Schmelzer et al. | 208/101 |
| 4,482,369 | 11/1984 | Carson et al. | 62/18 |
| 4,568,451 | 2/1986 | Greenwood et al. | 208/340 |
| 5,178,751 | 1/1993 | Pappas | 208/340 |
| 5,238,555 | 8/1993 | Pappas et al. | 208/340 |
| 5,245,099 | 9/1993 | Mitariten | 585/650 |

OTHER PUBLICATIONS

"Catalytic LPG Dehydrogenation Fits in '80's Outlook" by Roy C. Berg et al., Oil & Gas Journal pp. 191–197 (Nov. 10, 1980).

*Primary Examiner*—R. Bruce Breneman
*Assistant Examiner*—Bekir L. Yildirim
*Attorney, Agent, or Firm*—Thomas K. McBride; John G. Tolomei; Richard P. Silverman

[57] ABSTRACT

A process for recovering hydrogen-rich gases and increasing the recovery of liquid hydrocarbon products from a hydrocarbon conversion zone effluent is improved by a particular arrangement of a refrigeration zone, a pressure swing adsorption (PSA) zone, and up to two separation zones. The admixing of at least a portion of the tail gas from the PSA zone with a hydrogen-rich gas stream recovered from a first vapor-liquid separation zone results in significantly improved hydrocarbon recoveries and the production of a high purity hydrogen product. The process is especially beneficial in the integration of the catalytic reforming process with vapor hydrogen consuming processes such as catalytic hydrocracking in a petroleum refinery.

26 Claims, 4 Drawing Sheets

PSA PROCESS FOR IMPROVING THE PURITY OF HYDROGEN GAS AND RECOVERY OF LIQUEFIABLE HYDROCARBONS FROM HYDROCARBONACEOUS EFFLUENT STREAMS

FIELD OF THE INVENTION

The present invention generally relates to methods for using a pressure swing adsorption (PSA) zone in combination with a catalytic hydrocarbon conversion zone to improve the purity of a hydrogen-rich gas stream and to improve the recovery of liquefiable hydrocarbons from the hydrocarbon effluent of the catalytic hydrocarbon conversion zone.

BACKGROUND OF THE INVENTION

Various types of catalytic hydrocarbon conversion reaction systems have found widespread utilization throughout the petroleum and petrochemical industries for effecting the conversion of hydrocarbons to different products. The reactions employed in such systems are either exothermic or endothermic. Of more importance to the present invention, the reactions often result in either the net production of hydrogen or the net consumption of hydrogen. Such reaction systems, as applied to petroleum refining, have been employed to effect numerous hydrocarbon conversion reactions including those which predominate in catalytic reforming, ethylbenzene dehydrogenation to styrene, propane and butane dehydrogenation, etc.

Petroleum refineries and petrochemical complexes customarily comprise numerous reaction systems. Some systems within the refinery or petrochemical complex may result in the net production of hydrogen. Because hydrogen is relatively expensive, it has become the practice within the art of hydrocarbon conversion to supply hydrogen from reaction systems which result in the net production of hydrogen to reaction systems which are net consumers of hydrogen. Occasionally, the net hydrogen being passed to the net hydrogen-consuming reactions systems must be of high purity due to the reaction conditions and/or the catalyst employed in the systems. Such a situation may require treatment of the hydrogen from the net hydrogen-producing reaction systems to remove hydrogen sulfide, light hydrocarbons, etc. from the net hydrogen stream.

Alternatively, the hydrogen balance for the petroleum refinery or petrochemical complex may result in excess hydrogen, i.e., the net hydrogen-producing reaction systems produce more hydrogen than is necessary for the net hydrogen-consuming reaction systems. In such an event, the excess hydrogen may be sent to the petroleum refinery or petrochemical complex fuel system. However, because the excess hydrogen often has admixed therewith valuable components, such as $C_3+$ hydrocarbons, it is frequently desirable to treat the excess hydrogen to recover these components prior to its passage to fuel.

Typical of the net hydrogen-producing hydrocarbon reaction systems are catalytic reforming, catalytic dehydrogenation of alkylaromatics and catalytic dehydrogenation of paraffins. Commonly employed net hydrogen-consuming reaction systems are hydrotreating, hydrocracking and catalytic hydrogenation. Of the above-mentioned net hydrogen-producing and consuming hydrocarbon reaction systems, catalytic reforming ranks as one of the most widely employed. By virtue of its wide application and its utilization as a primary source of hydrogen for the net hydrogen-consuming reactions systems, catalytic reforming has become well known in the art of hydrocarbon conversion reaction systems.

It is well known that high quality petroleum products in the gasoline boiling range including, for example, aromatic hydrocarbons such as benzene, toluene and the xylenes, are produced by the catalytic reforming process wherein a naphtha fraction is passed to a reaction zone wherein it is contacted with a platinum-containing catalyst in the presence of hydrogen. Generally, the catalytic reforming reaction zone effluent, comprising gasoline boiling range hydrocarbons and hydrogen, is passed to a vapor-liquid equilibrium separation zone and is therein separated into a hydrogen-containing vapor phase and an unstabilized hydrocarbon liquid phase. A portion of the hydrogen-containing vapor phase may be recycled to the reaction zone. The remaining hydrogen-containing vapor phase is available for use either by the net hydrogen-consuming processes or as fuel for the petroleum refinery or petrochemical complex fuel system. While a considerable portion of the hydrogen-containing vapor phase is required for recycle purposes, a substantial net excess is available for the other uses.

Because the dehydrogenation of naphthenic hydrocarbons is one of the predominant reactions of the reforming process, substantial amounts of hydrogen are generated within the catalytic reforming reaction zone. Accordingly, a net excess of hydrogen is available for use as fuel or for use in a net hydrogen-consuming process such as the hydrotreating of sulfur-containing petroleum feedstocks. However, catalytic reforming also involves a hydrocracking function among the products of which are relatively low molecular weight hydrocarbons including methane, ethane, propane, butanes and the pentanes, substantial amounts of which appear in the hydrogen-containing vapor phase separated from the reforming reaction zone effluent. These normally gaseous hydrocarbons have the effect of lowering the hydrogen purity of the hydrogen-containing vapor phase to the extent that purification is often required before the hydrogen is suitable for other uses. Moreover, if the net excess hydrogen is intended for use as fuel in the refinery or petrochemical complex fuel system, it is frequently desirable to maximize the recovery of $C_3+$ hydrocarbons which are valuable as feedstock for other processes.

The pressure swing adsorption (PSA) process provides an efficient and economical means for separating a multi-component gas feedstream containing at least two gases having different adsorption characteristics. The more strongly adsorbable gas can be an impurity which is removed from the less strongly adsorbable gas which is taken off as product; or, the more strongly adsorbable gas can be the desired product, which is separated from the less strongly adsorbable gas. For example, it may be desired to remove carbon monoxide and light hydrocarbons from a hydrogen-containing feedstream to produce a purified, i.e., 99+%, hydrogen stream suitable for hydrocracking or other catalytic process where these impurities could adversely affect the catalyst or the reaction. On the other hand, it may be desired to recover more strongly adsorbable gases, such as ethylene, from a feedstream to produce an ethylene-rich product.

In pressure swing adsorption, a multi-component gas is typically fed to at least one of a plurality of adsorbent beds at an elevated pressure effective to adsorb at least one component, i.e. the adsorbate fraction, while at least one other component passes through, i.e. the non-adsorbed fraction. At a defined time, the feedstream to the adsorbent bed is terminated and the adsorbent bed is depressurized by one or more cocurrent depressurization steps wherein pressure is reduced to a defined level which permits the separated, less strongly adsorbed component or components remaining in the adsorption zone to be drawn off without significant concentration of the more strongly adsorbed components. The released gas typically is employed for pressure equalization and for subsequent purge steps. The bed is thereafter countercurrently depressurized and often purged to desorb the more selectively adsorbed component of the feedstream from the adsorbent and to remove such gas from the feed end of the bed prior to the repressurization thereof to the adsorption pressure.

Such PSA processing is disclosed in U.S. Pat. No. 3,430,418 to Wagner, U.S. Pat. No. 3,564,816 to Batta and in U.S. Pat. No. 3,986,849 to Fuderer et al., wherein cycles based on the use of multi-bed systems are described in detail. As is generally known and described in these patents, the contents of which are incorporated herein by reference as if set out in full, the PSA process is generally carried out in a sequential processing cycle that includes each bed of the PSA system.

Many processes for the purification of hydrogen-rich gas streams from the effluent of hydrocarbon conversion reaction zones are disclosed. U.S. Pat. No. 3,431,195, issued Mar. 4, 1969, discloses a process wherein the hydrogen and hydrocarbon effluent of a catalytic reforming zone is first passed to a low pressure vapor-liquid equilibrium separation zone from which zone is derived a first hydrogen-containing vapor phase and a first unstabilized hydrocarbon liquid phase. The hydrogen-containing vapor phase is compressed and recontacted with at least a portion of the liquid phase and the resulting mixture is passed to a second high pressure vapor-liquid equilibrium separation zone. Because the second zone is maintained at a higher pressure, a new vapor liquid equilibrium is established resulting in a hydrogen-rich gas phase and a second unstabilized hydrocarbon liquid phase. A portion of the hydrogen-rich vapor phase is recycled back to the catalytic reforming reaction zone with the balance of the hydrogen-rich vapor phase being recovered as a hydrogen-rich gas stream relatively free of $C_3$–$C_6$ hydrocarbons.

U.S. Pat. No. 5,178,751, issued Jan. 12, 1993, discloses a method for recovering high purity hydrogen gas and increasing the recovery of liquid hydrocarbon products from a hydrocarbon conversion zone effluent wherein the reaction zone effluent is first separated in a vapor-liquid equilibrium separation zone into a first hydrogen-containing vapor phase as a first liquid hydrocarbon phase. One portion of the first hydrogen-containing vapor phase is compressed and recycled back to the catalytic reaction zone. The balance of the hydrogen-containing vapor phase is cooled and recontacted with a portion of the first liquid hydrocarbon phase and passed to a second vapor-liquid separation zone to provide a second hydrogen-containing vapor phase and a second hydrocarbon phase. The second hydrogen-containing vapor phase is admixed with a portion of the first liquid hydrocarbon phase, refrigerated and passed to a third vapor-liquid separation zone to provide a high purity hydrogen stream and a third liquid hydrocarbon phase. The liquid hydrocarbon phases are collected and passed to fractionation for recovery of liquid hydrocarbon products. U.S. Pat. No. 5,178,751 is herein incorporated by reference.

Other references which disclose processes for improving the recovery of a hydrogen-rich gas stream reaction zone effluent comprising hydrogen and hydrocarbons from a hydrocarbon conversion zone include U.S. Pat. Nos. 4,568,451, 4,374,726, and 4,364,820.

In addition to the above-mentioned patent literature, the technical literature within the art has also disclosed methods for separating reaction zone effluents to obtain hydrogen-containing gas streams. For example, the Nov. 10, 1980 issue of the *Oil and Gas Journal* discloses an LPG dehydrogenation process in which the entire reaction zone effluent is first dried, then subjected to indirect heat exchange with a cool hydrogen-containing gas stream. The cool hydrogen-containing gas stream is derived by passing the entire cooled reaction zone effluent to a vapor-liquid equilibrium separation zone. The hydrogen-containing gas stream is removed from the separation zone and is then expanded. Thereafter it is subjected to indirect heat exchange with the entire reaction zone effluent. After the indirect heat exchange step, a portion of the hydrogen-containing vapor phase is recycled to the reaction zone.

The many art references have shown many similar arrangements of chillers, separators, absorbers, compressors, and heat exchange equipment for recovering a hydrogen-rich gas stream and liquefiable hydrocarbon components from a hydrocarbonaceous effluent of a catalytic conversion zone. Out of the many combinations of such components that can be used, it has been discovered that a particular arrangement of a pressure swing adsorption zone, separators and refrigeration equipment will dramatically improve the purity of the hydrogen recovered and improve recovery of liquefiable hydrocarbons in such a system with only a relatively simple arrangement of components.

SUMMARY OF THE INVENTION

It has been discovered that by the use of a pressure swing adsorption zone and a simple precooling step in combination with an additional separation zone, significant improvement in the hydrogen purity recovered and significant additional recoveries of $C_4$ and, in particular, $C_3$ hydrocarbons can be obtained.

Accordingly, in one embodiment, this invention is a process for producing a hydrogen-rich gas stream by treating an effluent comprising hydrogen and hydrocarbon from a catalytic hydrocarbon conversion reaction zone. In the process, at least a portion of the effluent is passed to a first vapor-liquid separation zone. A first hydrogen-rich gas stream having an initial hydrogen purity and a first liquid stream comprising hydrocarbons are recovered therefrom. A portion of the first hydrogen-rich gas stream, at least a portion of a tail gas stream, and at least a portion of the first liquid stream are admixed to produce a first admixture. The first admixture is passed to a second liquid vapor-liquid separation zone to produce a second hydrogen-rich gas stream and a second liquid stream. The second hydrogen-rich gas stream is passed to a pressure swing adsorption zone containing an adsorbent selective for the separation of hydrogen from hydrocarbons. The second hydrogen-rich gas stream is separated into a third hydrogen-rich gas stream and the tail gas stream. At least a portion of the third hydrogen-rich gas stream is recovered as a high purity hydrogen product.

In another embodiment, this invention is a process for producing a hydrogen-rich gas stream by treating an effluent comprising hydrogen and hydrocarbon from a catalytic reforming reaction zone. At least a portion of the effluent is passed to a first vapor-liquid separation zone and a first hydrogen-rich gas stream and a first liquid reformate stream comprising hydrocarbons are recovered therefrom. At least a portion of the first hydrogen-rich gas stream and at least a portion of a tail gas stream is admixed to produce a first admixture. The first admixture is contacted in a recontacting zone with at least a portion of the first liquid reformate stream to provide a recontacted hydrogen stream and a second liquid reformate stream. The recontacted hydrogen stream and at least a portion of the second liquid reformate stream are admixed to provide a second admixture. The second admixture is refrigerated to a recovery temperature to provide a refrigerated second admixture, and the refrigerated second admixture is passed to a second vapor-liquid separation zone to provide a second hydrogen-rich gas stream and a third liquid reformate stream. The second hydrogen-rich gas stream is passed to a pressure swing adsorption zone to provide a high purity hydrogen product stream and the tail gas stream. At least a portion of the tail gas stream is recovered for use as fuel.

In a further embodiment, this invention is a process for producing a hydrogen-rich gas stream by treating an effluent comprising hydrogen and hydrocarbon from a catalytic reforming reaction zone. In the process, at least a portion of the effluent is passed to a first vapor-liquid separation zone and a first hydrogen-rich gas stream and a first liquid stream comprising hydrocarbons are recovered therefrom. At least a portion of the first hydrogen-rich gas stream is cooled by indirect heat exchange with a second hydrogen-rich gas stream to provide a first heat exchanged hydrogen-rich gas stream. A portion of the first liquid stream comprising about 10 to 50 vol. % of the total first liquid stream is cooled by indirect heat exchange with a second liquid stream to provide a precooled first liquid stream. The first heat exchanged hydrogen-rich gas stream and the precooled first liquid stream are admixed to produce a first admixture. The first admixture is passed to a second vapor-liquid separation zone to produce a third hydrogen-rich gas stream and a third liquid stream. At least one of the third hydrogen-rich gas stream and the precooled first liquid stream are refrigerated and the first heat exchanged hydrogen-rich gas stream is admixed with the precooled first liquid stream to obtain a refrigerated second admixture. The refrigerated second admixture is passed to a third vapor-liquid separation zone to produce the second hydrogen-rich gas stream and a fourth liquid stream. The third and fourth liquid streams are combined to produce the second liquid stream which is recovered after the indirect heat exchange with a portion of the first liquid stream. The second hydrogen-rich gas stream is passed to a pressure swing adsorption zone to provide a hydrogen-rich product stream and a tail gas stream. At least a portion of the tail gas stream is admixed with the portion of the first hydrogen-rich gas stream prior to the indirect heat exchange with the second hydrogen-rich gas stream.

Other embodiments of the invention include the passing of the hydrogen-rich product stream to another catalytic hydrocarbon reaction zone such as a hydrocracking reaction zone to provide the catalytic hydrocracking reaction zone with a high purity hydrogen stream and thereby improve the yield and/or conversion within the catalytic hydrocracking reaction zone. In addition, a portion of the hydrogen-containing gas stream from the other catalytic hydrocarbon reaction zone may be admixed with the hydrogen-rich gas stream and passed to the pressure swing adsorption zone.

DETAILED DESCRIPTION OF THE INVENTION

Figure 1:
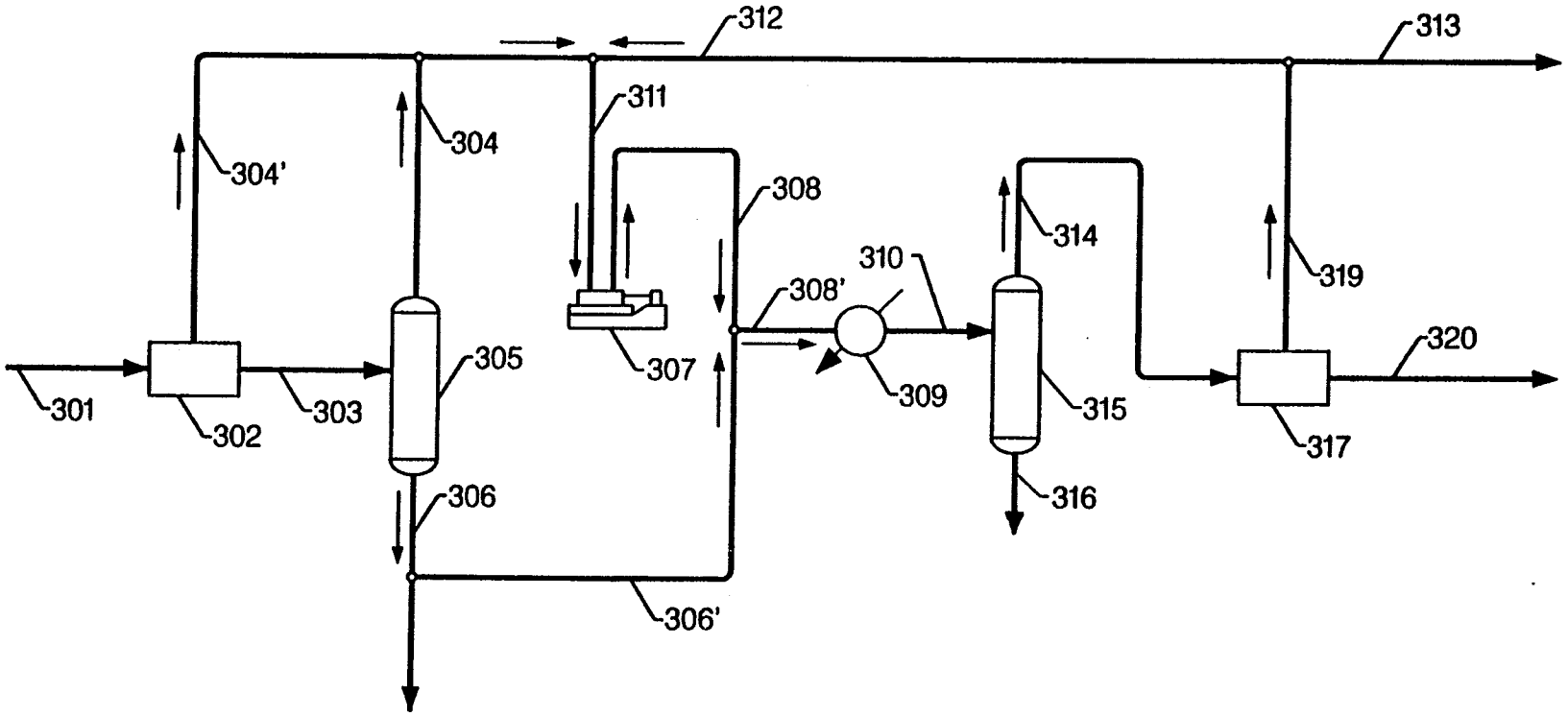
FIG. 1 illustrates a reforming process and separation arrangement for recovering a hydrogen-rich product and a liquid reformate according to this invention.

The process of this invention is suitable for use in hydrocarbon conversion reaction systems which may be characterized as single or multiple reaction zones in which catalyst particles are disposed as fixed beds or movable via gravity flow. Moreover, the present invention may be advantageously utilized in hydrocarbon conversion reaction systems which result in the net production or the net consumption of hydrogen. Although the following discussion is specifically directed toward catalytic reforming of naphtha boiling range fractions, there is no intent to so limit the present invention.

The art of catalytic reforming is well known to the petroleum refining and petrochemical processing industry. Accordingly, a detailed description thereof is not required herein. In brief, the catalytic reforming art is largely concerned with the treatment of a petroleum gasoline fraction to improve its anti-knock characteristics. The petroleum fraction may be a full boiling range gasoline fraction having an initial boiling point of from about 10° C. (50° F.) to about 38° C. (100° F.) and an end boiling point from about 163° C. (325° F.) to about 218° C. (425° F.). More frequently the gasoline fraction will have an initial boiling point to about 65° C. (150° F.) to about 121° C. (250° F.) and an end boiling point of from about 177° C. (350° F.) to about 218° C. (425° F.), this higher boiling fraction being commonly referred to as naphtha. The reforming process is particularly applicable to the treatment of those straight-run gasolines comprising relatively large concentrations of naphthenic and substantially straight-chain paraffinic hydrocarbons which are amenable to aromatization through dehydrogenation and/or cyclization. Various other concomitant reactions also occur, such as isomerization and hydrogen transfer, which are beneficial in upgrading the anti-knock properties of the selected gasoline fraction. In addition to improving the anti-knock characteristics of the gasoline fraction, the tendency of the process to produce aromatics from naphthenic and paraffinic hydrocarbons makes catalytic reforming an invaluable source for the production of benzene, toluene, and xylenes which are all of great utility in the petrochemical industry.

Widely accepted catalysts for use in the reforming process typically comprise platinum on an alumina support. These catalysts will generally contain from about 0.05 to about 5 wt. % platinum. Certain promoters or modifiers, such as cobalt, nickel, rhenium, germanium and tin, have been incorporated into the reforming catalyst to enhance its performance.

The catalytic reforming of naphtha boiling range hydrocarbons, a vapor phase operation, is effected at conversion conditions which include catalyst bed temperatures in the range of from about 700° to about 1020° F. Other conditions generally include a pressure of from about 138 kPa (20 psia) to about 6900 kPa (1000 psia), a liquid hourly space velocity (defined as volumes of fresh charge stock per hour per volume of catalyst particles in the reaction zone) of from about 0.2 to about 10 $hr.^{-1}$ and a hydrogen to hydrocarbon mole ratio generally in the range of from about 0.5:1 to about 10:1.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor vessel, or the catalyst beds may each be enclosed in a separate reactor vessel in a side-by-side reactor arrangement. Generally, a reaction zone will comprise two to four catalyst beds in either the stacked and/or side-by-side configuration. The mount of catalyst used in each of the catalyst beds may be varied to compensate for the endothermic heat of reaction in each case. For example, in a three-catalyst bed system, the first bed will generally contain from about 10 to about 30 vol. %; the second, from about 25 to about 45 vol. %; and the third, from about 40 to about 60 vol. %, all percentages being based on the amount of catalyst within the reaction zone. With respect to a four-catalyst bed system, suitable catalyst loadings would be from about 5 to about 15 vol. % in the first bed, from about 15 to about 25 vol. % in the second, from about 25 to about 35 vol. % in the third, and from about 35 to about 50 vol. % in the fourth. The reactant stream, comprising hydrogen and the hydrocarbon feed, should desirably flow serially through the reaction zones in order of increasing catalyst volume and interstage heating. The unequal catalyst distribution, increasing in the serial direction of reactant stream flow, facilitates and enhances the distribution of the reactions.

Continuous regenerative reforming systems offer numerous advantages when compared to the fixed bed systems. Among these is the capability of efficient operation at comparatively lower pressures, e.g., 20 to about 200 psig, and higher liquid hourly space velocities, e.g., about 3 to about 10 $hr.^{-1}$. As a result of continuous catalyst regeneration, higher consistent inlet catalyst bed temperatures can be maintained, e.g., 510° C. (950° F.) to about 543° C. (1010° F.). Furthermore, there is afforded a corresponding increase in hydrogen production and hydrogen purity in the hydrogen-containing vaporous phase from the product separation facility.

Upon removal of the effluent comprising hydrocarbon and hydrogen from the catalytic reaction zone, it is customarily subjected to indirect heat exchange typically with the hydrogen and hydrocarbon feed to the catalytic reaction zone. Such an indirect heat exchange aids in the further processing of the reaction zone effluent by cooling it and recovers heat, which would otherwise be lost, for further use in the catalytic reforming process. Following any such cooling step, which may be employed, the reaction zone effluent is passed to a vapor-liquid equilibrium separation zone to recover a hydrogen-rich gas stream from the effluent, at least a portion of which is to be recycled back to the reforming zone. The vapor-liquid equilibrium separation zone is usually-maintained at substantially the same pressure as employed in the reforming reaction zone, allowing for the pressure drop in the system. The temperature within the vapor-liquid equilibrium separation zone is typically maintained at about 15° C. to about 49° C. (about 60° to about 120° F.). The temperature and pressure are selected in order to produce a hydrogen-rich gas stream and a principally liquid stream comprising unstabilized reformate.

As noted previously, the catalytic reforming process generally requires the presence of hydrogen within the reaction zone. Although this hydrogen may come from any suitable source, it has become the common practice to recycle a portion of the hydrogen-rich gas stream derived from the vapor-liquid equilibrium separation zone to provide at least part of the hydrogen required to assure proper functioning of the catalytic reforming process. The balance of the hydrogen-rich gas stream is therefore available for use elsewhere. As noted above, a principally liquid phase comprising unstabilized reformate is withdrawn from the first vapor-liquid equilibrium separation zone. Pursuant to the invention, a portion of this unstabilized liquid reformate comprising from about 10 to 50 vol. % of the total reformate, and preferably 20 to 40 vol. %, is passed to a heat exchange means for indirect heat exchange with a hereinafter defined second unstabilized liquid reformate. After subjecting it to indirect heat exchange, the unstabilized liquid reformate is admixed with the hydrogen-rich gas stream which has also been subjected to indirect heat exchange.

Heat exchange of the first hydrogen-rich gas stream with a second hydrogen-rich gas stream precools the first hydrogen-rich gas stream before it enters a recontacting zone or second separation zone. Similarly heat exchange of the first liquid hydrocarbon stream from the first separator with a combined liquid product stream precools the liquid hydrocarbon stream that enters the second separator. This precooling will usually provide enough of a temperature reduction in the first hydrogen-rich gas stream to produce favorable equilibrium conditions in the second separation zone for reducing the content of liquefiable hydrocarbons in the third hydrogen-rich gas stream from the second vapor-liquid separation zone.

As the resulting first admixture is passed to the second vapor-liquid equilibrium separation zone, or recontacting zone, the composition temperature and pressure of the gas and vapor liquid entering the second vapor-liquid equilibrium separation zone is different from that in the first separation zone so that a new vapor equilibrium is established. Generally, the conditions within the second vapor-liquid separation zone will include a temperature of from about −4° C. to about 24° C. (about 25° F. to 75° F.), preferably, in a range of from about 4° C. to about 15° C. (about 40° F. to 60° F.) and a pressure of from about 345 kPa to about 3550 kPa (50 to 515 psia). This second vapor-liquid separation zone is generally operated at relatively warm conditions that will maximize the absorption of the liquefiable hydrocarbons by the liquid reformate stream. A vapor-liquid separation zone usually consists of an open vessel that operates in the nature of a flash drum. The pressure and temperature conditions within the second vapor-liquid separation zone will be set in order recover a recontacted hydrogen stream, or a third hydrogen-rich gas stream of medium purity. For the purposes of this invention, medium purity will usually mean a purity of 85 to 95 mol % hydrogen.

The third hydrogen-rich gas stream from the second vapor-liquid separation zone is admixed with another portion of the liquid reformate stream from the first separation zone or the second separation zone and subjected to refrigeration. The admixing of the liquid reformate stream with the third hydrogen-rich gas stream from the second separation zone can be done before or after refrigeration. The refrigeration lowers the temperature of the third hydrogen-rich gas stream and the liquid stream admixed therewith to a temperature of between about −16° C. and about 4° C. (about −15° and 40° F.), and preferably between about −26° C. and about −9° C. (about −15° and 15° F.).

After refrigeration and the addition of the liquid reformate stream, a second admixture is formed that will have a temperature of from −15° to 40° F. as it enters the third separation zone. The third vapor-liquid separation zone will normally operate in a pressure range of from about 345 kPa to about 3550 kPa (about 50 to 515 psia).

The third vapor-liquid separation zone uses a separator that is similar to that used for the second separation zone. This is again an equilibrium separation zone that now has equilibrium conditions that will transfer a further amount of the liquefiable hydrocarbons in the hydrogen-rich gas stream to the liquid reformate stream. The second hydrogen-rich gas stream and a fourth liquid reformate stream are withdrawn from the third vapor-liquid separation zone.

By the use of this invention, it has been determined that the overall addition of the liquefied reformate stream to the second and third separation zones can be kept in the range of from 10 to 50 vol. % of the unstabilized liquid reformate. Typically, the relative proportion of unstabilized liquid reformate sent to the second separation zone is in the range of from 5 to 25 vol. % and preferably in the range of 10 to 20 vol. % of the total liquid reformate stream with the balance sent to the third separation zone. In terms of the relative ratios between the two separation zones, about 40 to 60 vol. % of the liquid reformate is sent to the second separation zone with the balance passing to the third separation zone.

The second hydrogen-rich gas stream from the third separation zone provides substantial cooling to the hydrogen-containing vapor stream that forms a portion of the first admixture. Additional cooling of the liquid reformate stream is provided by the combined bottom streams from the second and third separation zones. It is possible to separately heat exchange the liquid stream from the third separation zone with the portion of the liquid stream that is admixed with the gas stream for the second separation zone in order to reduce the temperature of the admixture entering the second separation zone. This would be particularly useful when refrigeration is not used on the admixture entering the second separation zone. In some cases it may be desirable to provide refrigeration of the first admixture that enters the second separation zone. In such cases the temperature of the admixture will usually be in a range of from about −26° C. to about −9° C. (about −15° to 15° F.) before it enters the second separation zone and will have a pressure of from about 345 to about 3550 kpa (about 50 to 515 psia). For most applications of this invention it has been found that such additional refrigeration is not beneficial.

As will readily be recognized by the practitioner, upon precooling, a small portion of the first hydrogen-rich gas stream may partially condense; however, it is to be understood that the term "hydrogen-rich gas stream" as used herein is intended to include that small condensed portion. Hence, the entire hydrogen-rich gas stream including any portion thereof condensed upon precooling is admixed with the unstabilized liquid reformate.

In accordance with the present invention, at least the hydrogen-rich gas stream from the second separation zone and possibly the hydrogen-rich gas stream from the first separation zone are subjected to refrigeration. Although not typically necessary for catalytic reforming, it may be necessary to assure that these hydrogen-rich gas streams are sufficiently dry prior to refrigeration. Drying of the first hydrogen-rich gas stream from the first separation zone may be necessary because water, intentionally injected into the reaction zone or comprising a reaction zone feed contaminant must be substantially removed to avoid formation of ice upon refrigeration. By drying the first hydrogen-rich gas streams, formation of ice and the resulting reduction of heat transfer coefficients in the heat exchanger of the refrigeration unit utilized to effect the cooling are avoided.

If drying is required, it may be effected by any means known in the art. Absorption using liquid desiccants such as ethylene glycol, diethylene glycol, and triethylene glycol may be advantageously employed. In such an absorption system, a glycol desiccant is contacted with the hydrogen-containing vapor phase in an absorber column. Water-rich glycol is then removed from the absorber and passed to a regenerator wherein the water is removed from the glycol desiccant by application of heat. The resulting lean glycol desiccant is then recycled to the absorber column for further use. As an alternative to absorption using liquid desiccants, drying may also be effected by adsorption utilizing a solid desiccant. Alumina, silica gel, silica-alumina beads, and molecular sieves are typical of the solid desiccants which may be employed. Generally, the solid desiccant will be placed in at least two beds in a parallel flow configuration. While the hydrogen-containing vapor phase is passed through one bed of desiccant, the remaining bed or beds are regenerated. Regeneration is generally effected by heating to remove desorbed water and purging the desorbed water vapor from the desiccant bed. The beds of desiccant may, therefore, be cyclically alternated between drying and regeneration to provide continuous removal of water from the hydrogen-containing vapor phase.

In regard to refrigeration, any suitable refrigeration means may be employed. For example, a simple cycle comprising a refrigerant evaporator, compressor, condenser, and expansion valve or if desired, a more complex cascade system may be employed. The exact nature and configuration of the refrigeration scheme is dependent on the desired temperature of the refrigerated admixture and in turn that temperature is dependent on the composition of the admixture and the desired hydrogen purity of the hydrogen-rich gas. Preferably, the temperature should be as low as possible with some margin of safety to prevent freezing. Generally, the refrigeration temperature will be from about −26° C. to about −9° C. (about −15° to 15° F.). In addition, it should be noted that the exact desired temperature of the refrigerated admixture will determine whether drying of the hydrogen-containing vapor phase is necessary in order to avoid ice formation within the refrigeration heat exchanger and the concomitant reduction in heat transfer coefficient accompanied therewith. For catalytic reforming, a temperature of about −18° C. (about 0° F.) is usually suitable without the necessity of drying the hydrogen-containing vapor phase. This is because the water content of the hydrogen-containing vapor phase is about 20 mole ppm.

The reformate withdrawn from the second vapor-liquid separation zone as the third liquid stream will differ from the first unstabilized liquid reformate stream in that the third liquid stream will contain more $C_1$+ material transferred from the first hydrogen-rich gas stream. The unstabilized reform are withdrawn from the second and third, vapor-liquid equilibrium separation zones may be passed to a fractionation zone after being subjected to indirect heat exchange in accordance with the invention. By subjecting the second unstabilized reformate to indirect heat exchange, it is thereby preheated prior to its passage to the fractionation zone. The indirect heat exchange step therefore results in supplementary energy savings by avoiding the necessity of heating the unstabilized reformate from the temperature at which the second and third vapor-liquid equilibrium separation zones are maintained prior to fractionation and also by reducing the refrigeration requirement of the system.

The hydrogen-rich gas stream withdrawn from the third vapor-liquid equilibrium separation zone will preferably have, depending on the conditions therein, a hydrogen purity in excess of 90 mol. %. After subjecting the hydrogen-rich gas stream to indirect heat exchange pursuant to the invention, the hydrogen-rich gas stream is typically be passed to other hydrogen-consuming processes. It should be noted that by subjecting the hydrogen-rich gas stream to indirect heat exchange with the hydrogen-containing vapor phase, there accrues certain supplementary energy savings. Accordingly, by subjecting the hydrogen-rich gas to indirect heat exchange and thereby warming it, energy savings will be achieved, avoiding the necessity of heating the hydrogen-rich gas stream from the temperature maintained in the third vapor-liquid equilibrium separation zone. Additionally, such a heat exchange step decreases the total refrigeration requirements further reducing the energy requirements of the system.

In accordance with the present invention, the hydrogen-rich gas stream from the third vapor-liquid separation zone is passed to a pressure swing adsorption (PSA) zone to produce a hydrogen stream with a purity ranging from 90.0 to 99.9999 mol % hydrogen, and preferably from 95.0 to 99.99 vol.-% hydrogen. A tail gas stream is produced by the PSA zone during a desorption or purge step at a desorption pressure ranging from about 35 kPa to about 550 kPa (about 5 psia to about 80 psia). It was found that the return of a portion of the tail gas stream to a liquid hydrocarbon recovery scheme at a point prior to a recontacting step, the recovery of liquid hydrocarbons from the reactor effluent could be improved.

The present invention can be carried out using any adsorbent material which is selective for the separation of hydrogen from hydrocarbons in the adsorbent beds within the PSA zone. Suitable adsorbents known in the art and commercially available for use in the PSA zone include crystalline molecular sieves, activated carbons, activated clays, silica gels, activated aluminas, and combinations thereof. Preferably the adsorbents used with the present invention will be selected from the group consisting of activated carbon, alumina, activated alumina, silica gel, and combinations thereof.

It was found that there was a significant benefit in the integration of the PSA zone with a catalytic reformer when the hydrogen content in the hydrogen-rich gas from the first separation zone was greater than 70 mol-% hydrogen, and preferably when the hydrogen purity of the hydrogen-rich gas from the first separation zone was greater than 77 mol-% hydrogen. It was found that surprising economic benefits resulted when at least 20 to 75 percent of the tail gas stream from the PSA zone was returned to the recontacting zone, preferably the portion of the tail gas from the PSA zone returned to the recontacting zone will range from about 20 to about 60 percent, and most preferably the portion of the tail gas from the PSA zone stream returned to the recontacting zone will range from about 45 to about 55 percent of the tail gas stream.

The production of a hydrogen product stream with a purity greater than 99 vol % hydrogen is particularly valuable when the hydrogen-consuming process unit to which this hydrogen product stream will be sent is a catalytic unit. It was found that the increase in the purity of the hydrogen product stream sent to a catalytic hydrocracking reaction zone from a catalytic reforming unit using the process of this invention resulted in significant utility and capital savings in the combination of the catalytic hydrocracking reaction zone and the catalytic reforming reaction zone. It is believed that the increase in the purity of the hydrogen increases the partial pressure of hydrogen in the catalytic hydrocracking reaction zone which permits the operating of the hydrocracking reaction zone at a lower pressure for the same degree of conversion.

The operation of the PSA zone of the invention relates to conventional PSA processing comprising a plurality of adsorption beds containing an adsorbent selective for the separation of hydrogen from the hydrocarbons, wherein each adsorption bed within the adsorption zone undergoes, on a cyclic basis, high pressure adsorption, optional cocurrent depressurization to intermediate pressure level(s) with release of void space from the product end of the adsorption bed, countercurrent depressurization to lower desorption pressure with the release of desorbed gas from the feed end of the adsorption bed, with or without purge of the bed, and repressurization to higher adsorption pressure. The process of the present invention may also include an addition to this basic cycle sequence, which includes the use of a cocurrent displacement step, or co-purge step in the adsorption zone following the adsorption step in which the less readily adsorbable component, or hydrogen, is essentially completely removed therefrom by displacement with an external displacement gas introduced at the feed and of the adsorption bed. The adsorption zone is then countercurrently depressurized to a desorption pressure that is at or above atmospheric pressure with the more adsorbable component being discharged from the feed end thereof. In the multibed adsorption systems to which the invention is directed, the displacement gas used for each bed is advantageously obtained by using at least a portion of the debutanizer overhead vapor stream, although other suitable displacement gas such as an external stream comprising $C_1$ to $C_4$ hydrocarbons may also be employed if available with respect to the overall processing operation in which PSA with product recovery is being employed.

Those skilled in the art will appreciate that the high pressure adsorption step of the PSA process comprises introducing the feedstream or hydrogen-rich gas stream to the feed end of the adsorption bed at a high adsorption pressure. The hydrogen passes through the bed and is discharged from the product end thereof. An adsorption front or fronts are established in the bed with said fronts likewise moving through the bed from the feed end toward the product end thereof. Preferably, the adsorption zone pressure ranges from about 345 kPa to about 3550 kPa (about 50 to about 515 psia). It is to be understood that the adsorption zones of the present invention contain adsorber beds containing adsorbent suitable for adsorbing the hydrocarbon components to be adsorbed therein. As the capacity of the adsorber bed for the hydrocarbon components is reached, that is, preferably before a substantial portion of the leading adsorption front has passed through the first adsorber bed, the feedstream is directed to another bed in the adsorption zone. The loaded bed is then desorbed by depressurizing the bed to a desorption pressure in a direction countercurrent to the feeding step. Next, the bed is purged for further desorption and void space cleaning by passing a purge gas therethrough, preferably in a countercurrent direction. It is to be also understood that the term "countercurrent" denotes that the direction of gas flow through the adsorption zone, i.e., adsorption bed, is countercurrent with respect to the direction of feed stream flow. Similarly, the term "concurrent" denotes flow in the same direction as the feedstream flow. The purge gas is at least partially comprised of an effluent stream, e.g., the adsorption effluent stream or the cocurrent displacement effluent stream, from the adsorption zone and is rich in hydrogen, i.e., the greater than 50 mol. % hydrogen. Of course it is to be understood that the adsorption cycle in the adsorption zone can comprise additional steps well known in PSA such as cocurrent depressurization steps or cocurrent displacement steps. Accordingly, the adsorption zone can comprise more than two adsorption beds. The desorption and purge effluent streams from the adsorption zone can be recovered from the process as a tail gas stream.

By the process of this invention, a displacement gas is passed through the bed in a direction cocurrent to the feeding step. By the use of a cocurrent displacement gas essentially free of hydrogen, thus having a molar concentration of hydrocarbon components relative to the feedstream, the hydrocarbon components that remains in the void spaces of the adsorbent bed ahead of the leading adsorption front can be essentially completely displaced from the bed. Depending upon the available pressure of the displacement gas, the cocurrent displacement step can be performed in conjunction with one or more cocurrent depressurization step. When a cocurrent depressurization step is used, it can be performed either before, simultaneously with, or subsequent to the displacement step. The final pressure achieved during cocurrent depressurization steps is intermediate between the adsorption and desorption pressures and is preferably within the range of from about 300 kPa to about 1830 kPa (about 45 psia to about 265 psia). The effluent stream from the cocurrent depressurization step, which is comprised primarily of hydrogen, can be used to partially repressurize another adsorption bed. It can also be utilized, at least in part, to purge the adsorption zone as hereinbefore described.

After the termination of the cocurrent displacement step and any desired cocurrent depressurization step(s), the adsorption bed is desorbed by reducing the pressure in a direction countercurrent to the feeding direction to a desorption pressure. Other hydrogen-containing streams such as vent gases from catalytic hydrocarbon reaction zones originating from such processes as catalytic hydrotreating reaction zones or catalytic hydrocracking reaction zones can benefit from the hydrogen enrichment provided by the instant invention. Accordingly, a portion of a hydrogen-rich gas stream from another hydrocarbon reaction zone can be admixed with the second hydrogen-rich gas stream of the instant invention to recover additional hydrogen for the other hydrocarbon reaction zone. A portion of the high purity hydrogen product is returned to the other hydrocarbon reaction zone.

To more fully demonstrate the attendant advantages of the present invention, the following examples, based on thermodynamic analysis, engineering calculations, and estimates are set forth. Details such as miscellaneous pumps, heaters, coolers, valving, startup lines, and similar hardware have been omitted as being nonessential to a clear understanding of the techniques involved.

DETAILED DESCRIPTION OF THE DRAWINGS

Referring to FIG. 1, a naphtha boiling range hydrocarbon feedstock 301 is passed to a hydrocarbon conversion reaction zone 302 to produce a reaction zone effluent 303. An effluent comprising hydrogen and hydrocarbon from the reaction zone is passed via line 303 to a first vapor-liquid equilibrium separation zone 305 to provide a first hydrogen-rich gas stream 304 comprising 70 to 80 mole % hydrogen and a first liquid stream 306, comprising hydrocarbons. A portion of the first hydrogen-rich gas stream is returned to the hydrocarbon conversion reaction zone in line 304'. At least a portion of the first hydrogen-rich gas stream 304 is admixed with at least a portion of a tail gas stream 312 and at least a portion of the first liquid stream 306' to provide a first admixture 311. The first hydrogen-rich gas stream and the portion of the tail gas stream may be compressed as necessary in compressor 307 to raise the pressure to the range from about 345 kPa to about 3550 kPa (about 50 to 515 psia) prior to admixing the compressed stream with the first liquid stream. At least a portion of the tail gas stream may be compressed as necessary, preferably to a pressure ranging from 140 kPa to about 700 kPa (about 20 psia to about 160 psia), to be combined with the first hydrogen-rich gas stream to produce a hydrogen admixture. The compression of the portion of the tail gas stream and the compression of the hydrogen admixture can be performed in different stages of the same compressor 307. At least a portion and preferably all of the first liquid phase is passed via line 306' to be admixed with the hydrogen admixture in line 308 to provide the first admixture in line 308'. The first admixture is passed via line 308' to a heat exchanger 309 to precool the first admixture providing a precooled first admixture having a temperature from about 38° C. (about 100° F.) to about 10° C. (about 50° F.). The precooled first admixture is passed via line 310 to a second vapor-liquid separation zone 315 to provide a second hydrogen-rich gas stream 314 and a second liquid stream 316. The second hydrogen-rich gas stream is passed to a pressure swing adsorption zone 317 and the second liquid stream 316 is passed to downstream fractionation (not shown). Preferably the downstream fractionation will include a debutanizer column to provide a debutanized hydrocarbon product, an LPG (liquefied petroleum gas) product, and a debutanizer overhead vapor stream comprising propane. According to the present invention, at least a portion of the overhead vapor stream is returned to the recontactor, or, in another embodiment, the at least a portion of the overhead vapor is used as a copurge stream in the PSA zone.

A hydrogen product stream is withdrawn in line 320 from the pressure swing adsorption zone 317 at an adsorption pressure ranging from about 345 kPa to about 3550 kPa (about 50 psia to about 515 psia) as a high purity hydrogen product stream. A tail gas stream 319 is withdrawn from the pressure swing adsorption zone at a desorption pressure ranging from about 35 kPa to about 550 kPa (about 5 psia to about 80 psia). At least a portion of the tail gas stream is recycled to be admixed with the first hydrogen-containing vapor phase via line 312 preferably at a point between the first vapor-liquid separation zone and the recontacting zone or second vapor-liquid separator zone. A portion of the tail gas stream is withdrawn via line 313 for use as fuel.

Figure 2:
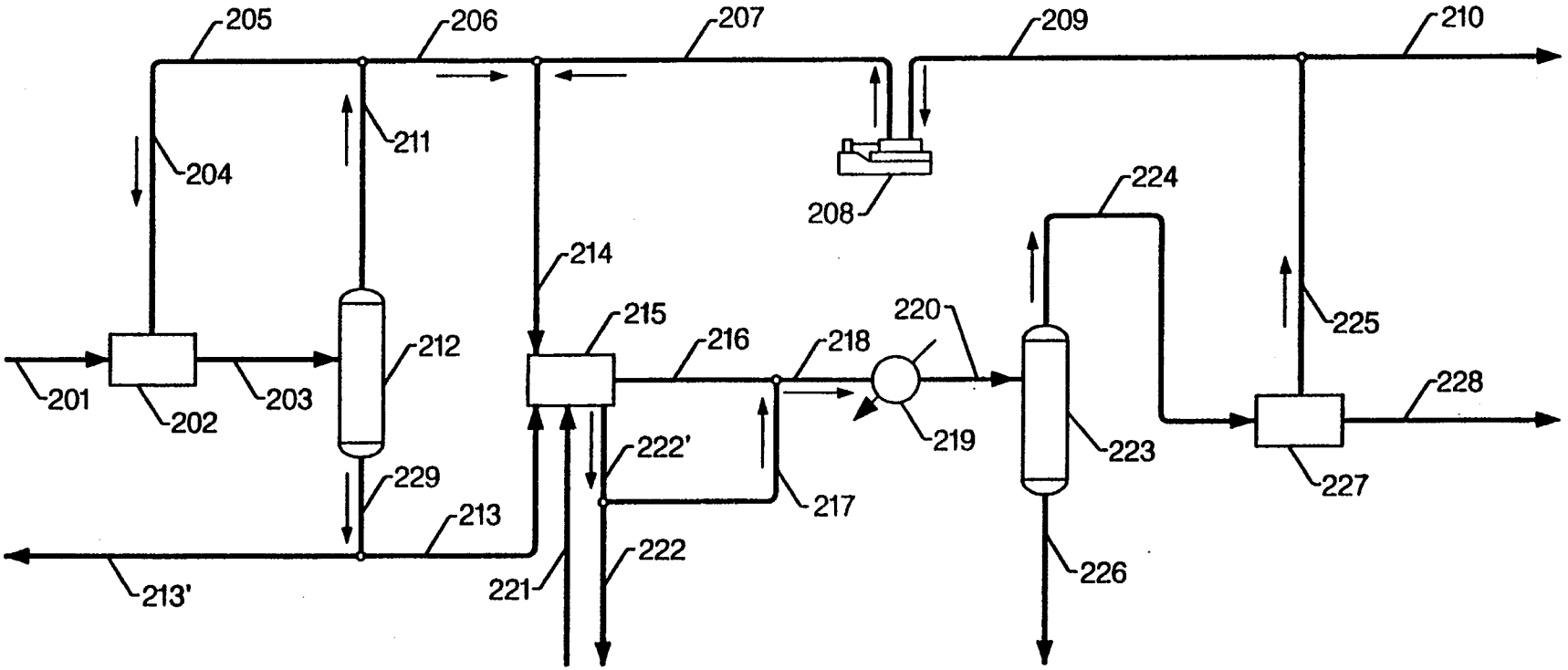
FIG. 2 shows a reforming process with a system for recovering a hydrogen-rich gas product and a reformate liquid product arranged in accordance with an alternate embodiment of this invention.

Referring to FIG. 2, a naphtha boiling range hydrocarbon feedstock 201 is passed to catalytic reforming reaction zone 202 to produce a reaction zone 203. The reaction zone effluent comprising hydrogen and hydrocarbon is passed via line 203 to a first vapor-liquid equilibrium separation zone 212 to provide a first hydrogen-rich gas stream 211 and a first liquid reformate stream 229. A portion of the first liquid reformate is passed in line 213' to fractionation including a debutanizer column (not shown). At least a portion of the first hydrogen-rich gas stream 211 is returned to the catalytic reforming reaction zone 202 via lines 205 and 204. At least a portion of the first hydrogen-rich gas stream via lines 211 and 206 is admixed with a portion of a tail gas stream in line 207 to form a first admixture, and the first admixture is passed via line 214 to a recontacting zone 215. In the recontacting zone, the first admixture is contacted with at least a portion of the first liquid reformate stream 213 and further contacted with at least a portion of a debutanizer column overhead vapor stream in line 221 to provide a recontacted hydrogen stream 216 and a second liquid reformate stream 222'. At least a portion of the second liquid reformate stream is withdrawn in line 222 and passed to the debutanizer column (not shown) as a portion of the feed to the debutanizer column. At least a portion the second liquid reformate stream is passed via line 217 and admixed with the recontacted hydrogen stream in line 216 to form a second admixture in line 218. The second admixture is passed to cooler 219 which refrigerates the second admixture to a temperature to a range of about −26° C. (−15° F.) to about −9° C. (15° F.). The refrigerated second admixture is passed to a second vapor-liquid separation zone 223 via line 220 to provide a second hydrogen-rich gas stream in line 224 and a third liquid reformate stream 226. Preferably the pressure of the recontacting zone will be maintained at a higher pressure than the pressure of the second vapor-liquid separation zone so that the recontacted hydrogen stream will not require recompression. This can be accomplished by compressing the second admixture to a pressure ranging from about 450 kPa (65 psia) to about 4140 kPa (600 psia) before refrigerating the second admixture (not shown). The third liquid reformate stream in line 226 is withdrawn and passed to the debutanizer column to recover the additional amount of light hydrocarbons comprising propane and butane in the liquefied petroleum gas, LPG, product. The second hydrogen-rich gas stream in line 224 is passed to a pressure swing adsorption zone 227 containing an adsorbent selective for the adsorption of hydrocarbons from streams containing hydrogen and hydrocarbons. A high purity hydrogen stream is withdrawn in line 228 as a hydrogen product. The tail gas stream is withdrawn in line 225. At least a portion of the tail gas stream is passed via line 209 to a compressor 208 to recompress the at least a portion of the tail gas stream to raise the pressure of the portion of the tail gas to a pressure necessary prior to admixing the portion of the tail gas stream with the first hydrogen-rich gas stream in line 206. A portion of the tail gas stream 225 is passed via line 210 to fuel. The portion of the tail gas stream in line 210 may be compressed as necessary to enable the portion of the tail gas stream to be available at fuel pressure for use as fuel.

Figure 3:
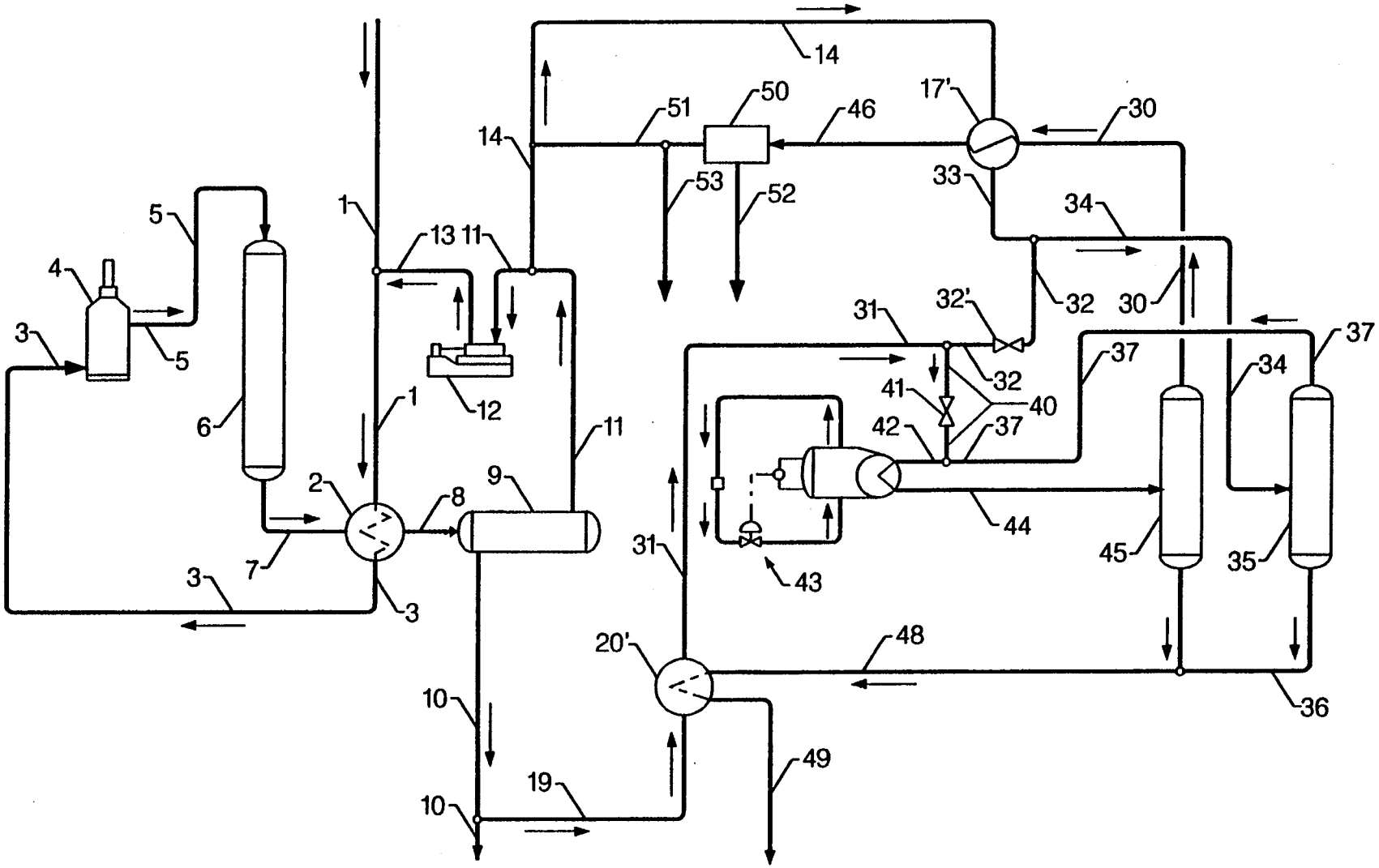
FIG. 3 is another reforming process with a system for recovering a hydrogen-rich product and a liquid reformate arranged in accordance with an alternate embodiment of this invention.

Specifically referring to FIG. 3, a naphtha boiling range hydrocarbon charge stock is introduced via line 1 and mixed with a hydrogen-rich gas stream recycled via line 13. The admixture is then passed through line 1 to combined feed exchanger 2 wherein the hydrogen and hydrocarbon charge are subjected to indirect heat exchange with an effluent comprising hydrogen and hydrocarbon from the catalytic reforming reaction zone. The thusly preheated hydrogen and hydrocarbon charge mixture is then withdrawn from the combined feed exchanger 2 via line 3. It is then passed into charge heater 4 wherein the hydrogen and hydrocarbon charge stock are heated to a reaction zone temperature of about 540° C. (about 1000° F.).

After being heated in charge heater 4, the hydrogen and hydrocarbon charge stock are passed via line 5 into catalytic reforming reaction zone 6 and contacted with a reforming catalyst comprising platinum. The effluent therefrom comprising hydrogen and hydrocarbons is withdrawn from reaction zone 6 via line 7 and passed to combined feed exchanger 2. As noted above, the effluent from reaction zone 6 is subjected to indirect heat exchange with the hydrogen and hydrocarbon admixture in line 1. As a result of this heat exchange, the temperature of the reaction zone effluent is lowered from about 550° C. (1020° F.) to about 93° C. (200° F.). In addition, although not depicted in the present drawing, the temperature of the reaction zone effluent is further reduced to about 38° C. (100° F.) or less by subjecting it to indirect heat exchange with ambient air and/or cooling water.

The reaction zone effluent is passed via line 8 to a first vapor-liquid equilibrium separation zone 9 to produce a first hydrogen-rich gas stream comprising 75 to 85 mol. % hydrogen and a first unstabilized liquid reformate. The first vapor-liquid separation zone operates at a temperature of about 38° C. (100° F.) and a pressure of about 345 kPa to about 3550 kPa (about 50 to about 515 psia). The first hydrogen-rich gas stream is withdrawn from the first vapor-liquid equilibrium separation zone 9 via line 11. In order to satisfy the hydrogen requirements of the catalytic reforming reaction zone, a first portion of the hydrogen-rich gas stream is passed via line 11 to recycle compressor 12. The first portion of the first hydrogen-rich gas stream is then passed via line 13 for admixture with the naphtha boiling range charge stock in line 1. A second portion of the hydrogen-rich gas stream comprising the balance thereof is diverted through line 14. The first unstabilized liquid reformate stream is withdrawn from the first vapor-liquid equilibrium separation zone 9 via line 10. A portion comprising about 10 to 50 Vol. %, preferably 20 to 40 vol. % of the total unstabilized liquid reformate is diverted via line 19. The balance of the unstabilized liquid reformate is continued through line 10 and passed to fractionation facilities not depicted herein.

At least a portion of the first hydrogen-rich gas stream is again diverted by line 14, admixed with at least a portion of a tail gas stream in line 51, compressed if necessary, and then carried through a precooling heat exchanger 17' where it is heat exchanged against a second hydrogen-rich gas stream carried by line 30 to provide a first heat exchanged hydrogen-rich gas stream in line 33. Passing the portion of the first hydrogen-containing vapor phase through precooler 17' cools the gas stream from a temperature of about 38° C. (100° F.) to a temperature of about −1° C. (30° F.). The portion of the first unstabilized liquid reformate stream carried by line 19 passes through a precooling heat exchanger 20' where it is cooled from a temperature of about 38° C. (100° F.) to a temperature of about 10° C. (50° F.) by heat exchange against a second liquid phase reformate stream 48. Line 31 carries the second liquid reformate stream from the precooling heat exchanger 20'. Approximately 50 vol. % of stream 31 comprising a first portion of the precooled liquid reformate is diverted by a line 32 at a rate regulated by a control valve 32' and combined into a first admixture with the precooled hydrogen-containing gas stream that is carried by line 33. The first admixture at a temperature of about −1° C. to about 16° C. (about 30° to 60° F.) is carried by a line 34 into a second vapor-liquid separation zone 35. Separation zone 35 produces a third unstabilized liquid reformate stream carried by line 36 from the bottom of the separation zone and a third hydrogen-rich gas stream taken overhead from the separator by a line 37. Line 37 carries the third hydrogen-rich gas stream into a second admixture with a second portion of the precooled liquid reformate stream from a line 40 at a rate regulated by control valve 41. The admixture of lines 41 and 37 has a temperature of about −1° C. to about 21° C. (about 30° to 70° F. and is carried by a line 42 into a refrigeration zone 43 that reduces the temperature of the second admixture to about −26° C. to about −9° C. (about −15° to 15° F.). Line 44 carries the refrigerated second admixture from the refrigeration zone to a third vapor-liquid separation zone 45. Separation zone 45 provides the second hydrogen-rich gas stream having a higher hydrogen purity relative to the overhead carried by line 37. Heat exchange of the second hydrogen-rich gas stream in line 30 through precooler 17' raises its temperature to about 27° C. to about 38° C. (about 80° to 100° F.). The cooled second hydrogen-rich gas stream is recovered from heat exchanger 17' by a line 46 and passed to a pressure swing adsorption (PSA) zone 50 to provide a hydrogen-rich product stream in line 52 at an adsorption pressure ranging from about 345 kPa to about 3550 kPa (about 50 to about 515 psia) and a tail gas stream. At least a portion of the tail gas stream in line 51 which is withdrawn from the PSA zone at a desorption pressure ranging from about 35 kPa to about 550 kPa (about 5 to about 80 psia) is admixed with a portion of the first hydrogen-rich gas stream prior to the indirect heat exchange with the first hydrogen-rich gas stream. Preferably the portion of the tail gas stream which is admixed with the portion of the first hydrogen-rich gas stream is less than 75% of the tail gas stream, and more preferably the first portion of the tail gas stream is between 20 and 60% of the tail gas stream. The remaining portion of the tail gas stream in line 53 is recovered for use as fuel. Where required, the remaining portion of the tail gas stream may be compressed to the pressure of the fuel system.

Additional unstabilized liquid reformate as a fourth liquid reformate stream is withdrawn from the bottom of the third vapor-liquid separation zone 45 by a line 47 and combined with the third liquid reformate stream from separator 35 into a combined liquid reformate stream in line 48 to provide the second liquid phase. Heat exchange in precooler 20' raises the temperature of the combined liquid reformate of line 48 from about 10° C. to about 27° C. (50° to 80° F.). The cooled combined liquid reformate stream is recovered by a line 49 and passed to fractionation facilities not shown here.

EXAMPLES

The following examples are based on engineering design calculations and reaction zone models developed from extensive pilot plant and commercial data to more fully demonstrate the attendant advantages of the present invention.

Example I

A hydrocarbon feedstock having a specific gravity of about 0.7279 gm/cc at 15° C., a molecular weight of about 107, a distillation range comprising an initial boiling point of about 80° C. (180° F.) and a final boiling point of about 158° C. (317° F.), and a hydrocarbon type analysis comprising approximately 71.5 vol.-% paraffin, 17.1 vol.-% naphthenes, and 11.4 vol.-% aromatics was charged to a catalytic reforming reaction zone having a weighted average reactor inlet temperature of about 530° C. to 538° C. (990°–1000° F.) and a separator pressure about 448 kPa (65 psia). The reaction zone was operated to provide debutanized product having a research octane number of about 100. A hydrogen-rich gas was produced at a purity of 87 Vol. % using a single vapor-liquid separation zone and a debutanizer to separate the hydrogen gas and recover the liquid products which include liquefied petroleum gas (LPG) comprising propane and butanes and catalytic reformate. The total product flows for Example I are shown as Case A in Table 1. The LPG production was 990 barrels per calendar day (BPCD) and the 100 octane reformate production was 11,386 BPCD. The total reactor effluent and the ultimate or ideal product amounts are shown below:

| | LPG | REFORMATE | |
|---|---|---|---|
| BPSD | (MMSCFD) | BPSD | BPSD |
| Hydrogen | (21.87) | | |
| Methane | 297 | | |
| Ethane | 790 | | |

-continued

| BPSD | LPG (MMSCFD) | REFORMATE BPSD | REFORMATE BPSD |
|---|---|---|---|
| Propane | 764 | 2,672 | |
| i-Butane | 336 | | |
| n-Butane | 483 | | |
| i-Pentex | 612 | | |
| n-Pentex | 448 | | 11,639 |
| Hexane+ | 10579 | | |
| Total | 14,309 | | |

The hydrogen amount is shown at 100% purity. The LPG and reformate amounts are indicated at 100% or theoretical liquid recovery. Any recovery scheme which improves the purity of the hydrogen product will result in the loss of some hydrogen. A series of schemes were developed to produce a high purity hydrogen stream while simultaneously improving the recovery of the liquid products.

TABLE 1

CATALYTIC REFORMING PRODUCTS WITH VARIOUS GAS PROCESSING SCHEMES

| CASE | LPG BPSD | REFORMATE BPSD | $H_2$ MMSCFD | $H_2$ PURITY | FUEL GAS MLB/HR |
|---|---|---|---|---|---|
| A | 990 | 11,386 | 24.54 | 87% | — |
| B | 990 | 11,386 | 18.74 | 99.9 | 12.9 |
| C | 1225 | 11,500 | 19.97 | 99.9 | 9.8 |

TABLE 2

| CASE | LPG BPSD | REFORMATE BPSD | $H_2$ MMSCFD | $H_2$ PURITY | FUEL GAS MLB/HR |
|---|---|---|---|---|---|
| A | 1450 | 11,629 | 23.56 | 91% | — |
| B | 1450 | 11,629 | 18.87 | 99.9 | 7.094 |
| C | 1654 | 11,639 | 20.15 | 99.9 | 5,323 |

Example II

The reaction zone effluent of Example I was processed according to the scheme shown in FIG. 1 employing a recontaction zone and a PSA zone, except that none of the PSA tail gas in line 319 was returned in lines 312 and 311 to the recontacting zone 315. As shown in Table 1 as case B, the purity of the hydrogen gas produced by the PSA zone improved from 87% to 99.9% and a significant amount of tail gas was produced as a fuel gas. No increase in liquid product was observed; and, in fact, the overall hydrogen recovery as product hydrogen was reduced to 85.4 percent.

Example III

The reaction gas effluent of Example I was processed according to the scheme shown in FIG. 1, employing a recontacting zone 315 and a PSA zone (317) wherein a portion of the tail gas was returned to the recontacting zone. As shown in Table 1 as case C, the amount of high purity hydrogen increased over case B and both the LPG and reformate production increased. The LPG production increased over 23 percent and the reformate production increased by about 114 BPCD. The overall hydrogen recovery was 90.4 percent. The additional estimated incremental cost for case C over case B of Example II represents about $376,000, but the additional product value, less operating cost provides about a 100 percent return on the incremental investment for the recompression of the tail gas and the increase in capacity required in the recontacting and PSA zones.

Example IV

The reaction zone effluent of Example I was processed according to the scheme in FIG. 2, employing a recontacting zone (215) and a refrigeration and second separation zone, but without PSA zone (222). The production of liquid products and hydrogen for Example IV is shown in Table 2 as case A. The hydrogen purity of the hydrogen produced was 91 mol %. The LPG yield was 1,450 BSD and the reformate yield was 11,629 BPSD.

Example V

The reaction zone effluent of Example I was processed according to the scheme shown in FIG. 2, except that no portion of the tail gas stream was returned to the recontacting zone (215). The production of liquid products and high purity hydrogen is shown in Table 2 as case B. In this operation the PSA zone produced a high purity (99.9 mol-%) hydrogen stream and fuel gas or tail stream at an overall hydrogen recovery of 84.8 percent. No increase in liquid product yield over Example IV resulted from the PSA operation of Example V.

Example VI

The reaction zone effluent of Example I was processed according to the scheme shown in FIG. 3. In FIG. 3, at least a portion of the tail gas stream (51) from the PSA zone (50) is returned to the recontacting zone by admixing the portion of the tail stream with a portion of the vapor stream (14) from the first vapor-liquid separation zone (9). The product flows resulting from this scheme are shown in Table 2, case C. The overall hydrogen recovery for Example VI was 91.2%. Example VI produced about 253 BPSD more high octane reformate and 664 BPSD more LPG than the production of Example I. Furthermore, Example VI produced 204 BPSD of LPG and 10 BPSD of reformate more than Example V by the return of at least a portion, specifically 50% of the PSA tail gas to the recontacting zone. The return of this portion of the tail gas stream to other points in the scheme, downstream of the recontacting zone did not provide the benefit of the instant invention. For an estimated incremental investment of about $230,000, the return or investment of Example VI over the PSA scheme of Example V was about 76 percent. Example VI resulted in the highest overall hydrogen recovery for the production of a 99% purity hydrogen stream.

Example VII

Figure 4:
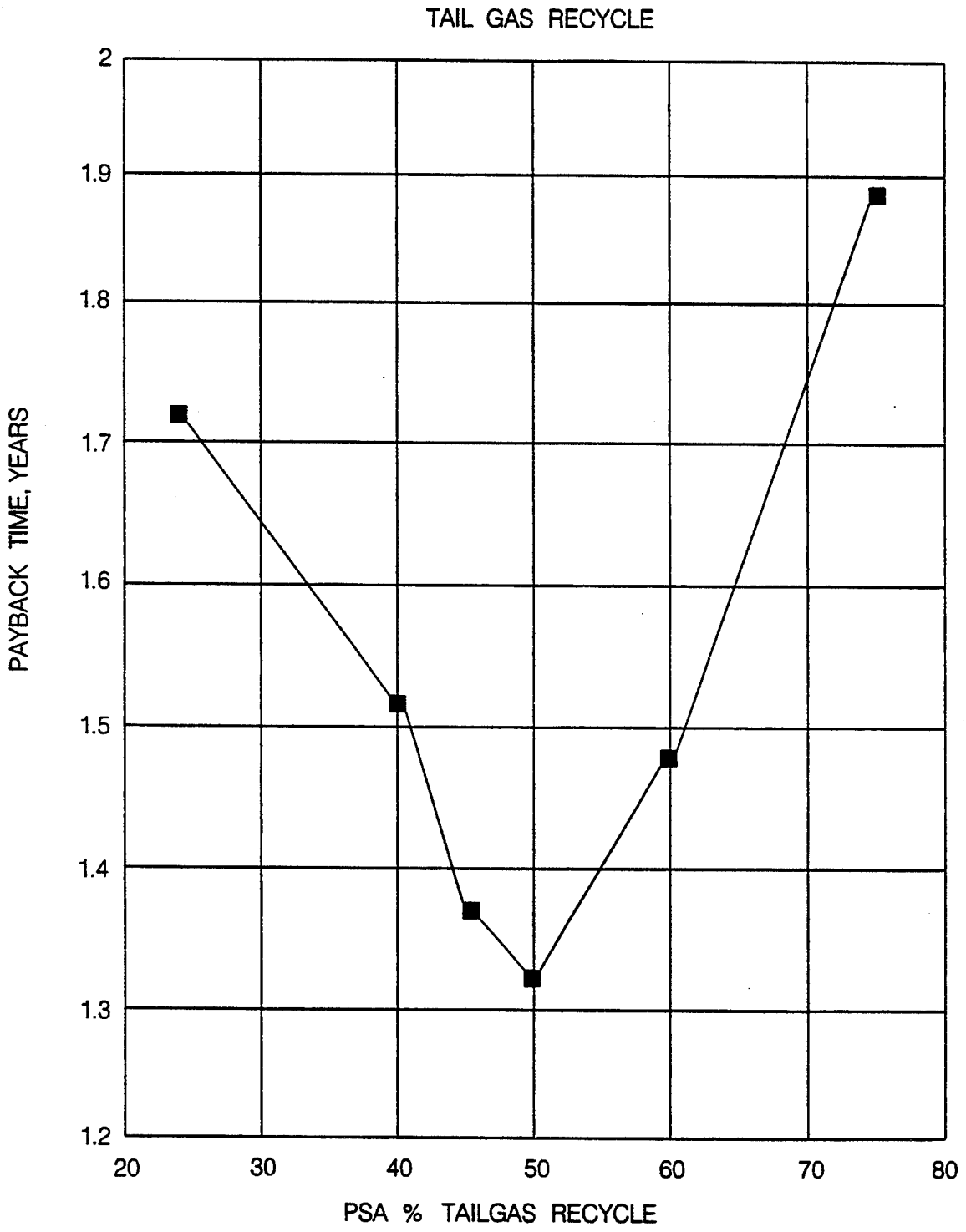
FIG. 4 is a chart showing the unexpected economic advantage of returning at least a portion of the PSA tail gas to the recontacting zone.

The scheme presented as Example VI was evaluated for varying amounts of tail gas returned to the recontacting zone from the PSA zone. FIG. 4 shows the unexpected improvement in the overall process economics as evidenced by the reduction in payout time as the portion of PSA tail gas recycled approached 50%. The payout time in years is determined by dividing the incremental investment cost of the PSA and liquid recovery equipment by the annualized incremental production value. Typically, one skilled in the art would expect that the economic viability of the scheme would decrease with increasing tail gas recycle. However, FIG. 4 shows that there is an unexpected economic advantage to return at least a portion, preferably from 25 to 75%, and most preferably from about 45% to about 55% of the tail gas to the recontacting zone according to the present invention.

What is claimed is:

1. A process for producing a hydrogen-rich gas stream by treating an effluent comprising hydrogen and hydrocarbon from a catalytic hydrocarbon conversion reaction zone comprising the steps of:

(a) passing at least a portion of said effluent to a first vapor-liquid separation zone and recovering therefrom a first hydrogen-rich gas stream having an initial hydrogen purity and a first liquid stream comprising hydrocarbons;

(b) admixing a portion of the first hydrogen-rich gas stream, at least a portion of a tail gas stream, and at least a portion of the first liquid stream to produce a first admixture;

(c) passing the first admixture to a second vapor-liquid separation zone to produce a second hydrogen-rich gas stream and a second liquid stream;

(d) passing said second hydrogen-rich gas stream to a pressure swing adsorption zone containing an adsorbent selective for the separation of hydrogen from hydrocarbons and separating said second hydrogen-rich gas stream into a third hydrogen-rich stream and the tail gas stream; and, (e) recovering at least a portion of said third hydrogen-rich stream as a high purity hydrogen product.

2. The process of claim 1 wherein the catalytic hydrocarbon conversion zone comprises a catalytic reforming reaction zone.

3. The process of claim 1 further comprising recompressing said portion of said tail gas stream prior to admixing said portion of said tail gas stream to produce said first admixture.

4. The process of claim 3 wherein said portion of the tail gas stream which is admixed to produce said first admixture is about 20 to about 60 percent of the tail gas stream from said pressure swing adsorption zone.

5. The process of claim 1 wherein said first admixture enters said second separation zone at a temperature of from about −7° to about 16° C. (about 20° to 60° F.) and a pressure of from about 345 kPa-about 3550 kPa (about 50 to 515 psia).

6. The process of claim 1 further comprising refrigerating said first admixture prior to passing said first admixture to said second vapor-liquid separation zone.

7. The process of claim 6 wherein said first admixture enters said second separation zone at a temperature of from about −26° C. to about −9° C. (about −15 ° to about 15° F.) and a pressure of from about 345 kPa to about 3550 kPa (about 50 to about 515 psia).

8. The process of claim 1 wherein the high purity hydrogen product contains between about 95 to about 99.99 mol % hydrogen.

9. The process of claim 1 wherein said initial hydrogen purity of said first hydrogen-rich gas stream is greater than 77 mol % hydrogen.

10. The process of claim 1 further comprising passing at least a portion of the high purity hydrogen product to a catalytic hydrocracking reaction zone.

11. The process of claim 1 wherein said adsorbent selective for the separation of hydrogen from hydrocarbons is selected from the group consisting of moleculor sieves, activated carbon, alumina, activated alumina, silica gel, and combinations thereof.

12. The process of claim 1 wherein the pressure swing adsorption zone comprises a plurality of adsorption beds each of said adsorption bed undergoing on a cyclic basis a high pressure adsorption step, an optional cocurrent depressurization step, and countercurrent depressurization step and an additional copurge step wherein the hydrogen within said adsorption bed is cocurrently displaced following said adsorption step with an external displacement gas.

13. The process of claim 12 wherein said external displacement gas is at least a portion of a debutanizer overhead vapor stream.

14. A process for producing a hydrogen-rich gas stream by treating an effluent comprising hydrogen and hydrocarbon from a catalytic reforming zone comprising the steps of:

(a) passing at least a portion of said effluent to a first vapor-liquid separation zone and recovering therefrom a first hydrogen-rich gas stream and a first liquid reformate stream comprising hydrocarbons;

(b) admixing at least a portion of the first hydrogen-rich gas stream and at least a portion of a tail gas stream to produce a first admixture;

(c) contacting the first admixture in a recontacting zone with at least a portion of the first liquid reformate stream to provide a recontacted hydrogen stream and a second liquid reformate stream;

(d) admixing said recontacted hydrogen stream and at least a portion of said second liquid reformate stream to provide a second admixture;

(e) refrigerating said second admixture to a recovery temperature to provide a refrigerated second admixture and passing the refrigerated second admixture to a second vapor-liquid separation zone to provide a second hydrogen-rich gas stream and a third liquid reformate stream;

(f) passing the second hydrogen-rich gas stream to a pressure swing adsorption zone to provide a high purity hydrogen product stream and the tail gas stream; and, (g) recovering at least a portion of said tail gas stream for use as fuel.

15. The process of claim 14 further comprising combining the second and third liquid reformate streams and passing a combined liquid phase to a debutanizer to provide a debutanized hydrocarbon product, a debutanizer overhead vapor stream comprising propane, and a debutanizer overhead liquid stream comprising LPG.

16. The process of claim 15 further comprising returning at least a portion of the debutanizer overhead vapor stream to the recontacting zone.

17. The process of claim 14 wherein a portion of the tail gas stream is admixed with the second admixture before said second admixture is refrigerated and said refrigerated second admixture is passed to said second vapor-liquid separation zone.

18. The process of claim 14 wherein the recovery temperature of step (e) ranges from about −26° C. (−15° F.) to about −9° C. (15° F.).

19. The process of claim 14 further comprising compressing the second admixture to a pressure ranging from 345 kPa (50 psia) to about 3550 kPa (515 psia) before refrigerating said second admixture.

20. The process of claim 14 further comprising recompressing said first portion of said tail gas stream prior to admixing said first portion of said tail gas stream with said hydrogen-containing vapor phase.

21. The process of claim 14 further comprising admixing a portion of a hydrogen-containing gas stream from another hydrocarbon reaction zone with said second hydrogen-rich gas stream and returning a portion of said high purity hydrogen product to said other hydrocarbon reaction zone.

22. A process for producing a hydrogen-rich gas stream by treating an effluent comprising hydrogen and hydrocarbon from a catalytic reforming reaction zone comprising the steps of:

(a) passing at least a portion of said effluent to a first vapor-liquid separation zone and recovering therefrom a first hydrogen-rich gas stream and a first liquid stream comprising hydrocarbons;

(b) cooling at least a portion of the first hydrogen-rich gas stream by indirect heat exchange with a second hydrogen-rich gas stream to provide a first heat exchanged hydrogen-rich gas stream;

(c) cooling a portion of the first liquid stream comprising about 10 to 50 vol. % of the total first liquid stream in indirect heat exchange with a second liquid stream to provide a precooled first liquid stream;

(d) admixing the first heat exchanged hydrogen-rich gas stream and the precooled first liquid stream to produce a first admixture;

(e) passing the first admixture to a second vapor-liquid separation zone to produce a third hydrogen-rich gas stream and a third liquid stream;

(f) refrigerating at least one of said third hydrogen-rich gas stream and said precooled first liquid stream and admixing said first heat exchanged hydrogen-rich gas stream with said precooled first liquid stream to obtain a refrigerated second admixture;

(g) passing the refrigerated second admixture to a third vapor-liquid separation zone to produce said second hydrogen-rich gas stream and a fourth liquid stream;

(h) combining said third and fourth liquid streams to produce said second liquid stream and recovering said second liquid stream after the indirect heat exchange with a portion of the first liquid stream;

(i) passing said second hydrogen-rich gas stream to a pressure swing adsorption zone to provide a hydrogen-rich product stream and a tail gas stream; and, (j) admixing at least a portion of said tail gas stream with said portion of said first hydrogen-rich gas stream prior to said indirect heat exchange with the second hydrogen-rich gas stream.

23. The process of claim 22 wherein said first admixture is refrigerated to provide a refrigerated first admixture and passing said refrigerated admixture to said second vapor-liquid separation device.

24. The process of claim 22 wherein the portion of the first hydrogen-rich gas stream is dried prior to indirect heat exchange with the second hydrogen-rich stream.

25. The process of claim 22 wherein the molar ratio of the portion of the first liquid stream passing in indirect heat exchange pursuant to step (c) to the first hydrogen-rich gas stream is about 0.25 to 0.5.

26. The process of claim 22 wherein the portion of the first liquid stream passing in heat exchange to step (c) comprises about 20 to 40 vol. % of the total first liquid stream.

* * * * *